US005217929A

United States Patent [19]

Taft

[11] Patent Number: 5,217,929

[45] Date of Patent: Jun. 8, 1993

[54] REFRACTORY COMPOSITION

[75] Inventor: Charles Taft, Atherstone, England

[73] Assignee: Foseco International Limited, Birmingham, England

[21] Appl. No.: 703,869

[22] Filed: May 23, 1991

[30] Foreign Application Priority Data

Jun. 7, 1990 [GB] United Kingdom ..... 9012677

[51] Int. Cl.[5] ..... C04B 35/02

[52] U.S. Cl. ..... 501/84; 501/108; 501/111; 501/116; 266/280; 106/38.27

[58] Field of Search ..... 106/38.27, 18.31; 501/111, 116, 84, 108; 266/280

[56] References Cited

U.S. PATENT DOCUMENTS

| | | | |
|---|---|---|---|
| 3,950,177 | 4/1976 | Birchall et al. | 106/55 |
| 3,966,482 | 6/1976 | Cassidy et al. | 106/64 |
| 4,039,344 | 8/1977 | Nishikawa et al. | 501/89 |
| 4,048,134 | 9/1977 | Courtenay et al. | 260/38 |
| 4,126,474 | 11/1978 | Talley et al. | 106/63 |
| 4,165,026 | 8/1979 | Hazlehurst et al. | 222/591 |
| 4,245,761 | 1/1981 | Hazlehurst et al. | 222/590 |
| 4,307,197 | 12/1981 | Daniel et al. | 501/100 |
| 4,396,431 | 8/1983 | Seeney et al. | 501/111 |
| 4,504,527 | 3/1985 | Hara et al. | 106/38.27 |
| 4,570,910 | 2/1986 | Geisler | 106/38.27 |
| 4,615,953 | 10/1986 | Ichikawa et al. | 106/38.27 |
| 4,617,280 | 10/1986 | Ivarsson et al. | 501/84 |
| 4,623,131 | 11/1986 | Roberts | 266/280 |
| 4,664,948 | 5/1987 | Moore et al. | 106/38.22 |
| 4,749,413 | 6/1988 | Tomic | 501/111 |
| 4,750,717 | 6/1988 | Pheasant et al. | 266/286 |
| 4,799,562 | 1/1989 | Burrows et al. | 177/229 |
| 4,834,798 | 5/1989 | Cisar et al. | 106/38.27 |
| 4,843,044 | 6/1989 | Neville et al. | 501/111 |
| 5,073,525 | 12/1991 | Cheng et al. | 501/95 |

FOREIGN PATENT DOCUMENTS

| | | |
|---|---|---|
| 078069 | 4/1984 | European Pat. Off. . |
| 0213900 | 3/1987 | European Pat. Off. . |

*Primary Examiner*—Karl Group
*Attorney, Agent, or Firm*—Nixon & Vanderhye

[57] ABSTRACT

A foamable lining composition to be used as an expendable lining over a permanent refractory lining in a molten metal handling vessel, e.g. a tundish, comprises a particulate refractory filler material, a binder, a foaming agent and water. Calcined magnesite is the preferred refractory filler material and the binder is preferably an acid phosphate or acid sulphate. The water is included in the composition in an amount of from 5 to 15 per cent by weight.

13 Claims, No Drawings

REFRACTORY COMPOSITION

This invention relates to refractory compositions for the lining of molten metal-handling vessels, for example, a ladle or tundish. It is particularly concerned to provide an expendable lining that overlies a permanent refractory lining in the vessel, the latter having an outer shell, usually of metal, e.g. steel. For convenience, the invention will be described with reference to the lining of tundishes, although it will be appreciated that it is not intended to be limited thereto.

It has, for some years now, been conventional practice to line metal-handling vessels such as tundishes with an expendable lining in the form of pre-fabricated slabs or boards. The slabs or boards may be vacuum-formed from a slurry comprising a particulate refractory filler material, e.g. calcined magnesite, together with a suitable binder, e.g. of resin, a small proportion of fibrous material, e.g. inorganic and/or paper and sintering aids. Such linings provide good insulation properties, have satisfactory refractoriness and enable uniform thickness of lining to be applied.

Alternative developments have been made with a view, for example, to reducing labour costs and these include, in particular, so-called 'spray systems' and 'dry vibratable systems'.

The spray system involves the spraying over the permanent lining of the tundish a composition which typically comprises a particulate refractory filler material, a sodium silicate binder, a small proportion of fibrous material, sintering aids, a very small amount of a wetting agent and up to 25%, typically 20 to 25% by weight of water. While having the advantages of lower labour cost compared to pre-formed boards and satisfactory refractoriness, the expendable linings so formed require considerable pre-heating of the vessel to remove the relatively large amount of water used and do not have such good insulation properties.

The dry vibration system involves the use of a similar particulate refractory filler material with a resin binder and a small amount of sintering aid, e.g. sodium silicate. A former is placed inside the tundish to define a cavity between former and tundish walls, the cavity corresponding to the desired, expendable lining. The cavity is filled with the dry lining composition and the former is vibrated to ensure adequate filling of the cavity. Heating the former and tundish then sinters the lining composition leaving it adhered to the walls of the tundish on removal of the former. Linings so formed are of relatively high density and hence can have greater refractoriness than those of the above—described methods. Insulation properties are not so good and the storage and movement of heavy formers requires operations involving a crane.

Although other alternative systems have been proposed, the present inventor is not aware of any other system that has obtained any widespread acceptance in the industry.

It is apparent from the above, therefore, that the present commercially-available lining systems all offer a balance of advantages and disadvantages and there is a continuing need for the development of systems that will provide further improvements towards optimisation of the balance of the various factors involved.

Accordingly, in one aspect the present invention provides a foamable lining composition for a molten metal handling vessel, the composition comprising a particulate refractory filler material, a binder, a foaming agent and water.

In another aspect the invention provides a molten metal handling vessel having a permanent refractory lining covered with a foamed, set expendable lining formed from the composition of the immediately preceding paragraph.

The particulate refractory material is preferably a magnesite, e.g. calcined magnesite, but any other suitable refractory filler material may be used. For example, olivine, calcined dolomite, silica, alumina (e.g. calcined bauxite or corundum), chromite, chamotte, zircon, aluminosilicate or other oxides or silicates may be used. Mixtures of these filler materials may be used if desired. The filler is preferably present in an amount of from about 78% to 94%, preferably 80% to 90%, by weight of the water-containing composition.

The binder is preferably an inorganic binder, and is preferably present in an amount from about 1% to 6% by weight of the water-containing composition. A reactive binder, e.g. an acid salt, is preferably used, which can react with the filler. Acid phosphates or sulphates may particularly be used and sodium dihydrogen phosphate is a preferred binder. However, where the filler is inert, small additions of reactive MgO or CaO may be added to facilitate the reaction. It is also possible to utilise a Sorrel cement in order to achieve the necessary degree of setting.

The foaming agent may be any suitable anionic, cationic or non-ionic surfactant, the selection of which for any particular composition is within the purview of the average skilled man of the art. It is preferably present in an amount from 0.01% to 1.0% by weight of the water-containing composition.

As indicated above, the water is included in an amount of from 5% to 15% by weight of the total composition, but from 8% to 12% by weight is especially preferred.

The composition may optionally include other ingredients, e.g. a minor amount of a foam stabiliser and inorganic or organic fibres. However, it is preferred that paper derivatives should not be included because they increase the water requirement of the composition.

The foamable compositions of the invention may be applied to the permanent lining of a vessel by any convenient means. They may, for example, be sprayed on to the required thickness in one or more layers or they may be extruded or 'gunned' over the permanent lining. In another embodiment the foamable composition may be pumped around a suitable former positioned in the, say, tundish.

The applied foamed composition is then heated and dried to form the desired lining, which is satisfactorily attached to the permanent lining.

Expendable linings of the invention have an improved optimisation of properties over previous commercial linings. They have excellent insulation, good refractoriness and require less vessel pre-heating than existing water-based systems. They are relatively inexpensive and not labour-intensive to install. They may have densities in the range 0.8 to 1.5 g/cc, preferably 1.0 to 1.3 g/cc.

One embodiment of the invention is now described by way of example only.

EXAMPLE

A mixture comprising 83.9% magnesite, 4% sodium dihydrogen phosphate, 0.1% sodium lauryl sulphate as foaming agent, 12% water was mixed in a continuous mixer and pumped via a mono-pump to the wall of a tundish where it was extruded onto the wall to a depth of 30 mm and fired at 1100° C. The resultant dried layer had a density of 1.1 g/cc and after 2 hours of casting showed no significant degree of wear.

I claim:

1. A lining composition for a molten metal handling vessel, consisting essentially of a refractory filler material;

a binder which reacts with said filler material, said binder being selected from the group consisting of acid phosphates and acid sulphates, and said binder being present in an amount of up to 6% by weight;

a foaming agent in an amount of up to 1% by weight; and water in an amount from 5 to 15% by weight of the composition.

2. A lining composition according to claim 1, in which the binder is sodium dihydrogen phosphates.

3. A lining composition according to claim 1, in which the binder is present in an amount of from 1 to 6% by weight of the water-containing composition.

4. A lining composition according to claim 1, in which the filler is calcined magnesite.

5. A lining composition according to claim 1, in which the filler is present in an amount of from 78 to 94% by weight of the water-containing composition.

6. A lining composition according to claim 1, in which the filler includes an inert filler and a minor amount of a reagent selected from Mg0 and Ca0 is incorporated.

7. A molten metal handling vessel having a permanent refractory lining covered by an expandable foam lining, consisting essentially of the expendable foam lining formed from a foamable composition;

said foam composition comprises a particulate refractory filler material, a binder which reacts with said filler material, said binder being selected from the group consisting of acid phosphates and acid sulphates, and said binder being present in an amount of up to 6% by weight;

a foaming agent in an amount of up to 1% by weight; and water in an amount from 5 to 15% by weight of the composition.

8. A molten metal handling vessel according to claim 7, in which the expendable lining was applied by spraying or gunning.

9. A molten metal handling vessel according to claim 7 in which the expandable lining has a density of from 1.0 to 1.3 g/cc.

10. A method of covering a lining of a molten metal handling vessel with an expandable foam lining, comprising the steps of:

(a) providing a vessel having a refractory lining;

(b) applying a foaming material to the vessel lining, said foaming material consisting essentially of a particulate refractory material having a reactive binder present in an amount of up to 6% by weight and selected from the group consisting of acid phosphates and acid sulphates, a foaming agent in an amount of up to 1% by weight and water in an amount from 5 to 15% by weight;

(c) heating said foaming material to form an expendable foam lining; and (d) drying said expendable foam lining.

11. A method according to claim 10, wherein step (b) the foaming material is applied by spraying.

12. A method according to claim 10, wherein step (b) the foaming material is applied by extruding.

13. A method according to claim 10, wherein step (b) the foaming material is applied by pumping the material around a suitable former.

* * * * *